US006675627B1

(12) United States Patent
Urech

(10) Patent No.: US 6,675,627 B1
(45) Date of Patent: Jan. 13, 2004

(54) METHOD AND DEVICE FOR FORMING CONICAL TUBE CASINGS

(75) Inventor: Werner Urech, Kaiserstuhl (CH)

(73) Assignee: Elpatronic AG, Bergdietikon (CH)

( * ) Notice: Subject to any disclaimer, the term of this patent is extended or adjusted under 35 U.S.C. 154(b) by 0 days.

(21) Appl. No.: 10/049,461

(22) PCT Filed: Apr. 6, 2000

(86) PCT No.: PCT/CH00/00202

§ 371 (c)(1),
(2), (4) Date: Feb. 13, 2002

(87) PCT Pub. No.: WO01/12356

PCT Pub. Date: Feb. 22, 2001

(30) Foreign Application Priority Data

Aug. 13, 1999 (CH) ..... 1482/99

(51) Int. Cl.[7] ..... B21D 51/10

(52) U.S. Cl. ..... 72/387; 72/51

(58) Field of Search ..... 72/51, 387, 414, 72/415

(56) References Cited

U.S. PATENT DOCUMENTS

| | | | | | |
|---|---|---|---|---|---|
| 61,678 | A | * | 1/1867 | Miller | 72/414 |
| 179,501 | A | * | 7/1876 | Aya | 72/414 |
| 800,508 | A | * | 9/1905 | Stambaugh | 72/387 |
| 2,701,001 | A | * | 2/1955 | James | 72/387 |

* cited by examiner

*Primary Examiner*—Lowell A. Larson
(74) *Attorney, Agent, or Firm*—McCormick, Paulding & Huber LLP

(57) ABSTRACT

To form metal sheet blanks into taper tubes, a die is provided which has a conical cavity into which a conical punch plunges. The punch is led into the die along a curve. Taper tube shells can easily be fabricated by this method.

8 Claims, 2 Drawing Sheets

METHOD AND DEVICE FOR FORMING CONICAL TUBE CASINGS

CROSS REFERENCE TO RELATED APPLICATION

Applicant hereby claims foreign priority benefits under 35 U.S.C. § 119 of PCT Application No. CH00/00202, filed Apr. 6, 2000, the disclosure of which is herein incorporated by reference.

BACKGROUND OF THE INVENTION

The invention relates to a method and apparatus for forming metal sheets into taper tube shells.

Taper tubes are desired for a multitude of applications. However, taper tube shells that can subsequently be welded to make a taper tube are expensive to fabricate.

Therefore the fundamental problem of the invention is to offer a simple way of rounding sheets conically.

SUMMARY OF THE INVENTION

This problem is solved in the case of a method of the kind stated at the outset, by employing a conical die and punch to deform an individual sheet. Initially the sheet is laid on the length of the die at the start of pressing, and the punch executes a curvilinear motion on plunging into the die.

Also the problem is solved in the case of an apparatus of the kind stated at the outset, by a matching conical punch and die set with actuating means by which the punch is insertable along a curved path into the die.

BRIEF DESCRIPTION OF THE DRAWINGS

Embodiments of the invention will now be described in detail, by way of example, with reference to the drawings, in which.

DESCRIPTION OF THE PREFERRED EMBODIMENTS

Figure 1:
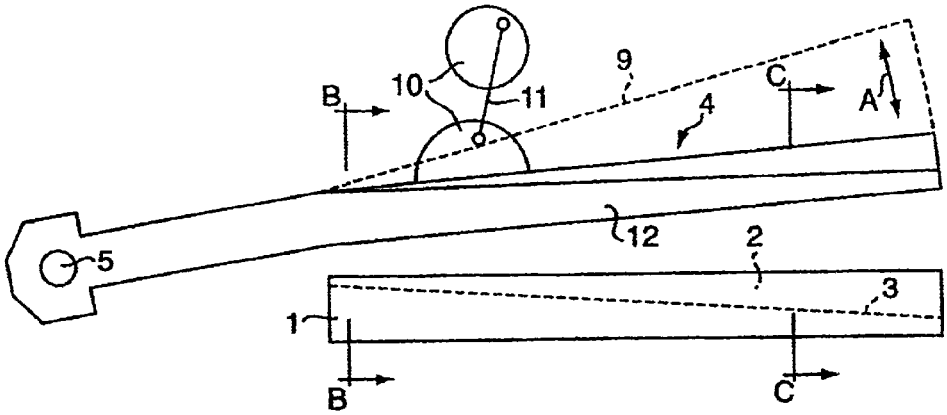
FIG. 1 is a schematic side view of a press apparatus with punch and die.
Figure 2A:
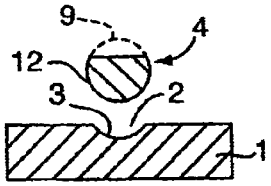
FIGS. 2*a*, 2*b* show cross-sections through punch and die.
Figure 2B:
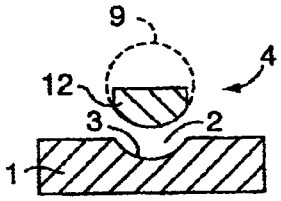

FIG. 1 is a highly schematic side view of an apparatus for taper forming metal sheets. Shown in the figure is a die 1 which has an internal cavity 2 tapering in the longitudinal direction as indicated in the figure by the broken line 3 representing the lowest surface line of the conical cavity 2, which forms part of a truncated cone. FIGS. 2*a* and 2*b* show the die 1 with its conical cavity 2 in vertical section along the section lines B—B and C—C of FIG. 1. The punch 4 is likewise formed with a conical taper in the longitudinal direction as part 12 of a truncated cone, and, in the region intended to plunge into the die 1, matches the shape of the conical cavity, less the thickness of the sheet to be formed. The punch 4 is also shown in vertical section in FIGS. 2*a* and 2*b* , from which the conical shape of the punch part 12 is evident. In the region that does not plunge into the die, the shape of the punch 4 departs from that of the truncated cone (which is suggested by the broken line 9), to facilitate removal of the tapered sheet. Instead of the round cross-sectional shape of punch and die shown in FIGS. 2*a* and 2*b* , any other desired conically tapering cross-sectional shapes could, of course, be used. In the example shown in FIG. 1, the punch 4 is pivotable about a pivot 5 so as to execute a curved movement as indicated by the arrow A as it plunges into the die 1. The drive for the punch 4 may take the form of a crank arrangement 10, 11, which is shown only schematically, and which moves the punch 4 into the die cavity 2 where it presses on the sheet, and withdraws the punch 4 from the die again along the curved denoted by the arrow A. Suitable crank mechanisms will be familiar to the expert, and do not need further description here. Instead of a pivot 5 and a crank mechanism, any other desired actuating elements can also be used, e.g. hydraulic or pneumatic actuating elements, which, as indicated in the following description, move the punch through the curve shown, or a curve of another form, into, and out of, the die.

Figure 3:
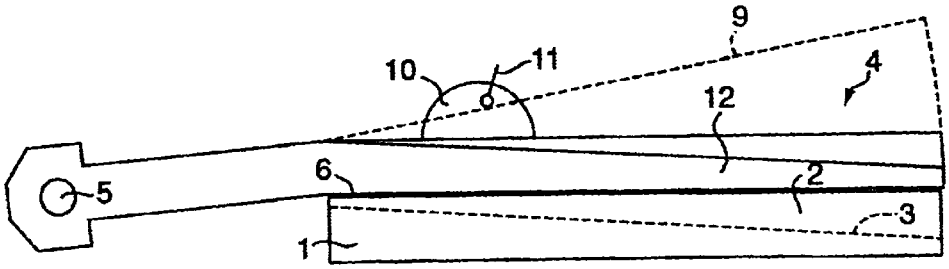
FIG. 3 shows the apparatus of FIG. 1 at the start of the pressing operation.
Figure 4:
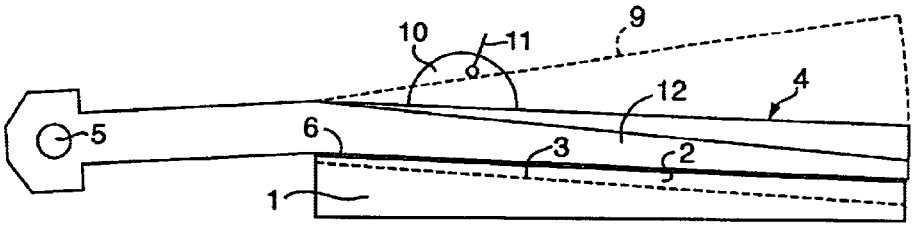
FIG. 4 shows the apparatus of FIG. 1 during the pressing operation.
Figure 5:
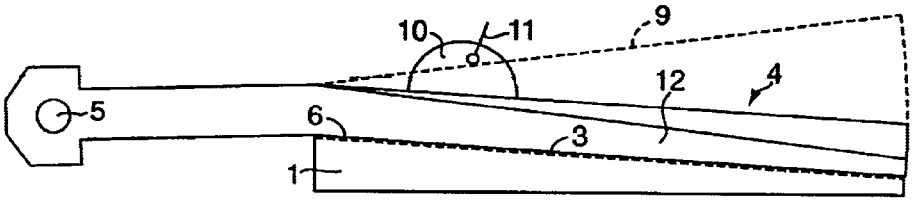
FIG. 5 shows the apparatus of FIG. 1 at the end of the pressing operation.
Figure 6:
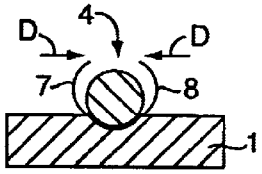
FIG. 6 shows additional forming wings.

FIG. 3 shows the same apparatus in a starting position, with a sheet 6 to be formed overlying the die cavity. The punch 4 is arranged so that in the starting position it contacts the sheet 6 substantially over its whole length, so that the ensuing forming of the sheet commences simultaneously over the entire length of the sheet. FIG. 4 shows the punch 4 as it plunges with its curvilinear motion into the die 1, in a position in which it has plunged about halfway into the die, which is shown transparently in the drawing so as to reveal the position of the punch 4 within the die. FIG. 5 shows the punch 4 in its end position, the curved motion preferably being executed in such a way that the sheet is brought in contact with the bottom of the die substantially simultaneously over the whole length of the punch. In this way the sheet is tapered uniformly and made to conform to the shape of the punch and die. In a known manner, bottoming may be performed in the end position shown in FIG. 5 to prevent springback. Using the described technique for pressing the sheet in the conical die, a lateral region of the sheet blank can be shaped first, then in a further step, another lateral region, and lastly, the central region, so that three pressing operations are involved in the production of the taper tube shell. But a larger number of pressing strokes, e.g. five or seven strokes, may be performed. The two marginal regions of the sheet blank may, however, have been preformed by other means, so that only the central part is tapered in a single pressing stroke according to the invention. As indicated schematically in FIG. 6, which shows a vertical section through a conical die and a conical punch, the central part of a sheet blank may for example also be tapered directly with punch and die, while for the marginal regions, forming wings 7 and 8 are additionally provided which are also conical, and can be closed around the punch 4 in the direction of the arrows D by actuating elements (not shown) so that the marginal regions of the sheet are also pressed on to the die.

What is claimed is:

1. A method for forming metal sheets into taper tube shells, the metal sheets each having a length, the method comprising the steps of:

providing a conical die and matching conical punch cone having a length; and pressing the metal sheet between the conical die and matching conical punch cone at least one forming step, wherein the conical punch contact the metal sheet lying on the conical die at the start of pressing substantially along the entire length of the metal sheet the conical punch executes a curvilinear motion on plunging into the die, and the punch plunges into the die so as to arrive at the bottom of the die at the same instant substantially over the entire length of the conical punch.

2. Method according to claim 1 characterized in that several forming steps are performed.

3. Method according to claim 1, characterized in that additional forming is performed with forming wings above the die.

4. Method according to claim 1 characterized in that three or more forming steps are performed.

5. Method according to claim 1 characterized in that in the case of a sheet with preformed marginal regions, a single forming step is performed in the central region of the sheet.

6. Apparatus for forming metal sheets into taper tube shells, comprising:

a die with a conical forming cavity;

a conical punch matched to the shape of the die;

actuating means by means of which the punch is pivotable about a pivot and insertable along a curved path into the die; and wherein the conical punch contacts the metal sheet lying on the die at the start of pressing, substantially along the entire length of the metal sheet over the die and the punch plunges into the die so as to arrive at the bottom of the die at the same instant substantially over the entire length of the conical punch.

7. Apparatus according to claim 6, characterized in that additional forming wings are provided by means of which sheet regions lying outside the die can be shaped.

8. An apparatus for forming metal sheets into taper tube shells, comprising:

a die with a conical forming cavity;

a conical punch having a length matched to the shape of the die;

a hydraulic, or pneumatic, actuating means by which the lunch is insertable along a curved path into the die;

additional forming wings are provided outside the die to shape regions of the metal sheet outside the die; and wherein the conical punch contacts the metal sheet having a length lying on the die at the start of pressing substantially along the entire length of the metal sheet over the die and the punch plunges into the die so as to arrive at the bottom of the die at the same instant substantially over the entire length of the conical punch.

* * * * *

UNITED STATES PATENT AND TRADEMARK OFFICE

CERTIFICATE OF CORRECTION

PATENT NO. : 6,675,627 B1
DATED : January 13, 2004
INVENTOR(S) : Werner Urech

It is certified that error appears in the above-identified patent and that said Letters Patent is hereby corrected as shown below:

Column 4,
Line 14, “lunch” should be replaced with -- punch --.

Signed and Sealed this

Sixteenth Day of March, 2004

JON W. DUDAS
*Acting Director of the United States Patent and Trademark Office*